United States Patent [19]

Boyd

[11] Patent Number: 5,020,932

[45] Date of Patent: Jun. 4, 1991

[54] HIGH TEMPERATURE CERAMIC/METAL JOINT STRUCTURE

[75] Inventor: Gary L. Boyd, Tempe, Ariz.

[73] Assignee: Allied-Signal Inc., Morris Township, N.J.

[21] Appl. No.: 480,695

[22] Filed: Feb. 15, 1990

Related U.S. Application Data

[62] Division of Ser. No. 280,761, Dec. 6, 1988, Pat. No. 4,934,138.

[51] Int. Cl.[5] ..... F16B 9/00

[52] U.S. Cl. ..... 403/30; 403/289; 403/404; 416/241 B; 416/244 A

[58] Field of Search ..... 416/241 B, 244 A, 244 R, 416/204 A, 198 A; 415/214.1; 60/39.32; 403/370, 28, 30, 24, 179, 289, 290, 258, 257, 260, 261, 371, 404

[56] References Cited

U.S. PATENT DOCUMENTS

| | | | |
|---|---|---|---|
| 1,721,060 | 7/1929 | Swartz . | |
| 2,297,508 | 9/1942 | Schutte . | |
| 2,625,415 | 1/1953 | Smith | 403/289 |
| 2,660,399 | 11/1953 | Robinson et al. . | |
| 3,300,233 | 1/1967 | Olson | 403/289 X |
| 3,335,580 | 8/1967 | Simpson, Jr. . | |
| 3,541,882 | 11/1970 | Testa | 403/258 X |
| 3,604,819 | 9/1971 | Krabe et al. . | |
| 3,680,979 | 8/1972 | Hansen et al. . | |
| 3,872,691 | 3/1975 | Hildebrandt . | |
| 3,943,703 | 3/1976 | Fronogard . | |
| 4,011,737 | 3/1977 | Kruger et al. . | |
| 4,152,096 | 5/1979 | Murakami et al. . | |
| 4,176,519 | 12/1979 | Kronogard . | |
| 4,694,544 | 9/1987 | Chapman | 403/290 X |
| 4,747,722 | 5/1988 | Kawaguchi et al. | 403/30 |
| 4,890,946 | 1/1990 | Von Pragenau | 403/284 X |

FOREIGN PATENT DOCUMENTS

| | | |
|---|---|---|
| 735504 | 4/1943 | Fed. Rep. of Germany . |
| 2714209 | 10/1977 | Fed. Rep. of Germany . |
| 3625996 | 2/1988 | Fed. Rep. of Germany . |
| 2230860 | 12/1974 | France . |
| 57-168004 | 10/1982 | Japan . |
| 59-20503 | 2/1984 | Japan . |
| 61-8410 | 1/1986 | Japan . |
| 55-9668 | 2/1944 | United Kingdom . |
| 578533 | 7/1946 | United Kingdom . |
| 1312339 | 4/1973 | United Kingdom . |
| 2034440 | 6/1980 | United Kingdom . |
| 2039331 | 8/1980 | United Kingdom . |

OTHER PUBLICATIONS

"Automotive Gas Turbine Ceramic Component Testing" Tech. Paper By W. D. Carruthers and G. L. Boyd.

"Ceramic Design Methodology and the Agt101" Tech Paper by G. L. Boyd, W. D. Carruthers, R. J. Evershed and J. R. Kidwell.

*Primary Examiner*—Peter M. Cuomo

*Attorney, Agent, or Firm*—Terry L. Miller; James W. McFarland; Robert A. Walsh

[57] ABSTRACT

A high temperature turbine engine includes a hybrid ceramic/metallic rotor member having ceramic/metal joint structure. The disclosed joint is able to endure higher temperatures than previously possible, and aids in controlling heat transfer in the rotor member.

9 Claims, 2 Drawing Sheets

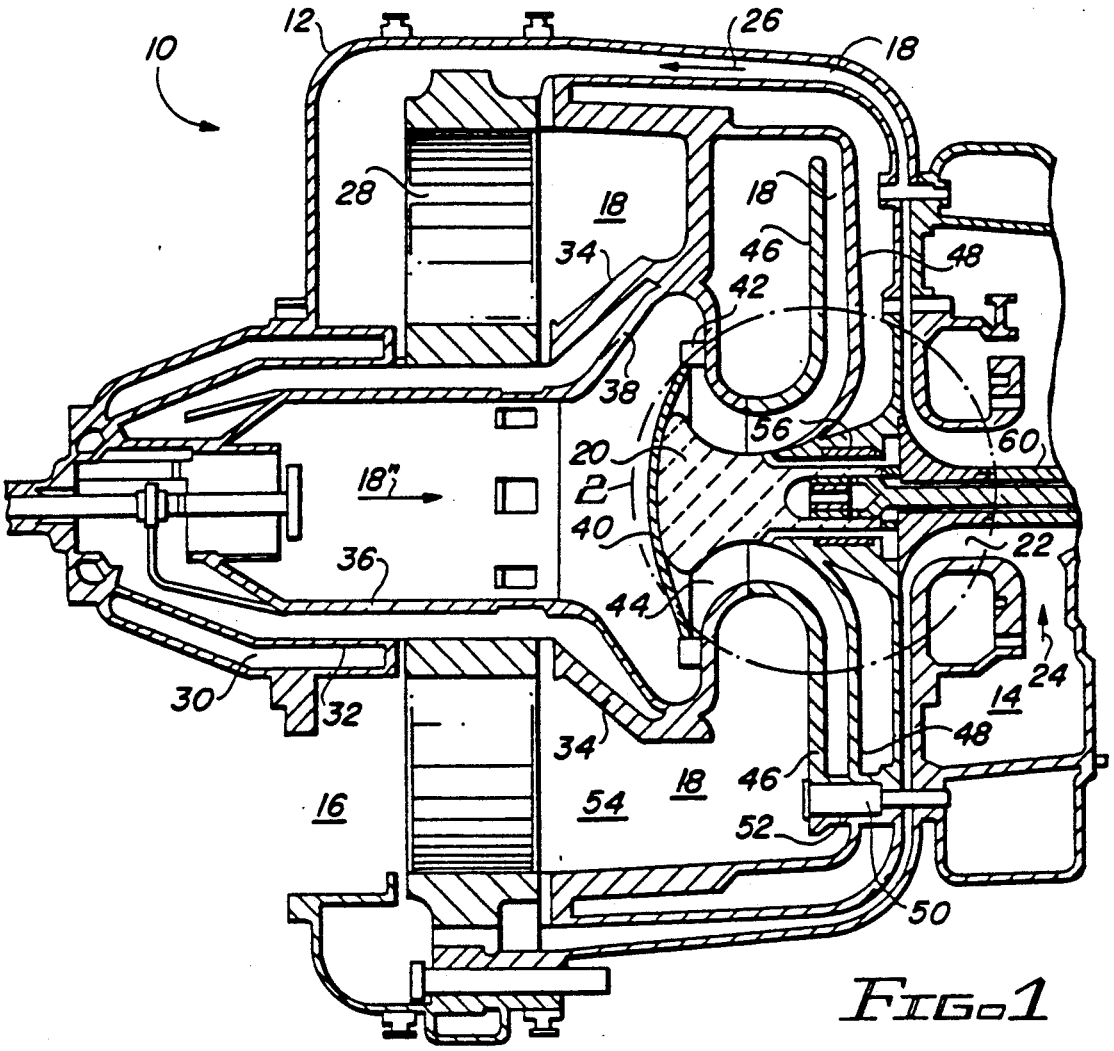
FIG. 1
FIG. 2
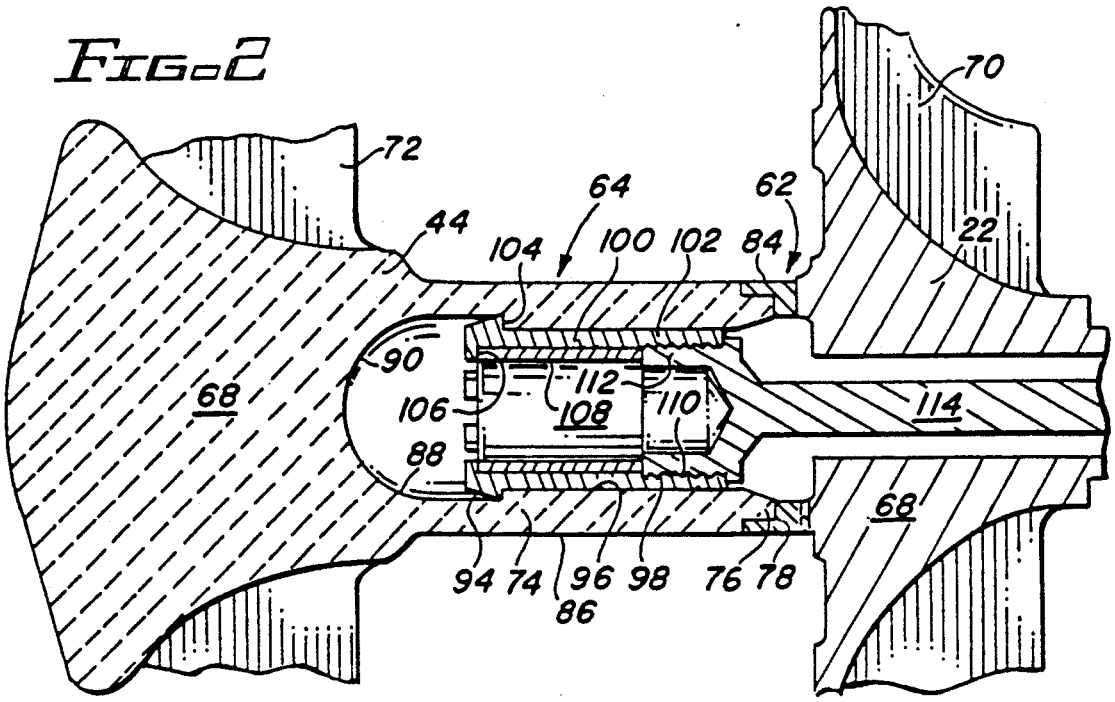

HIGH TEMPERATURE CERAMIC/METAL JOINT STRUCTURE

The United States Government has rights in the present invention pursuant to Contract No. DEN3-167 issued and funded by the Department of Energy (DOE), and administered by the National Aeronautics and Space Administration (NASA).

This is a division of application Ser. No 07/280,761 filed 12-06-88, now U.S. Pat. No. 4,934,138.

TECHNICAL FIELD

The present invention is in the field of high temperature turbine engine structure. Particularly, the present invention is directed to structure of a high temperature turbine engine composed of both metallic and ceramic components.

BACKGROUND OF THE INVENTION

A long-recognized need in the turbine engine art has been to attain higher operating temperatures in order to achieve both a greater thermodynamic efficiency and an increased power output per unit of engine weight. Ideally, a turbine engine should operate with stoichiometric combustion in order to extract the greatest possible energy value from the fuel consumed. However, the temperatures resulting from stoichiometric and even near-stoichiometric combustion are beyond the endurance capabilities of metallic turbine engine components. Consequently, as the turbine engine art has progressed, an ever greater emphasis has been placed upon both enhanced cooling techniques and the development of temperature and oxidation resistant metals for use in components of the engine which are exposed to the highest temperatures. That is, cooling techniques and high temperature metals have been developed for each of combustion chambers, turbine stator nozzles, and turbine blades. This quest has led to the development of elaborate cooling schemes for all of these components as well as to classes of nickel-based "super alloy" metals which may be cast using directionally solidified or single crystal techniques. All in all, the quest for higher operating temperatures in a turbine engine fabricated of metallic components has led to a still increasing complexity and expense in the making of the engine.

An alternative approach to the attainment of higher operating temperatures in a turbine engine has been recognized. This approach involves the use of high-strength ceramic components in the engine. Ceramic components are better able than metals to withstand the high temperature oxidizing environment of a turbine engine. However, the term 'high strength' in connection with ceramic structures must be viewed in context. While many ceramic materials exhibit superior high temperature strength and oxidation resistance, ceramics have historically been difficult to employ in turbine engines because of a comparatively low tensile fracture strength and a low defect tolerance. Consequently, a long-recognized need has been for the development of hybrid ceramic/metallic structures which utilize the characteristics of each material to best advantage in order to allow combustion in a turbine engine to take place closer to or at the stoichiometric level.

SUMMARY OF THE INVENTION

In view of the deficiencies of the conventional turbine engine art, and of the materials of construction and structural techniques available for making such engines, it is a primary object for this invention to provide a hybrid ceramic/metallic rotor structure for a turbine engine.

More particularly, it is an object for this invention to provide a structure uniting a ceramic turbine rotor portion with a metallic shaft portion for torque transmitting corotation with retention of axial and radial selected relationships, and allowance of differential thermal and centrifugal relative movements between the portions.

Still further, it is an object for this invention to provide a turbine engine wherein a ceramic turbine rotor portion and an axially adjacent metallic compressor rotor portion are coaxially united for torque transmitting corotation to define a substantial portion of a turbine engine rotor member.

Accordingly, the present invention provides a hybrid ceramic/metallic structure comprising: a first ceramic portion defining a respective first axially extending bore opening outwardly thereon, said first portion further defining on said first bore an annular step disposed away from said bore opening, a second portion axially adjacent said first ceramic portion, a metallic annular collet member received into said first bore and including a circumferentially arrayed plurality of axially elongate radially resilient finger portions, said plurality of finger portions proximate the distal end thereof defining a radially outwardly extending shoulder engaging said step, tensile means engaging said collet member and extending axially toward said second portion for applying an axially directed tensile force to the collet member which force is reacted through the second portion to secure the latter and said first portion axially together.

An advantage of the present invention is that it provides a hybrid ceramic/metallic turbine engine rotor member wherein the beneficial characteristics of each material are employed to best advantage.

Another advantage of the present invention resides in the positive axial and concentric mutual torque transmitting interrelationship established between the ceramic and metallic portions of the inventive rotor member.

Further to the above, because of the strong coaxially concentric relationship of the ceramic and metallic rotor member portions, a radially outwardly directed axially extending cylindrical surface part of the ceramic portion may be employed to define a journal bearing surface. That is, the rotor member may be journaled in a turbine engine by an external surface part of the ceramic portion so that only one additional bearing is required to satisfactorily support the rotor member. This one additional bearing may be located in a comparatively cooler portion of the turbine engine.

Additional obJects and advantages of the present invention will appear from a reading of the following detailed description of a single preferred embodiment of the invention taken in conjunction with the appended drawing figures.

BRIEF DESCRIPTION OF THE DRAWINGS

FIG. 1. provides a fragmentary longitudinal view, partly in cross section of a hybrid ceramic/metallic turbine engine embodying the invention;

FIG. 2 depicts an enlarged fragmentary cross sectional view of a portion of the engine presented by FIG. 1 with parts thereof omitted for clarity of illustration.

BEST MODE FOR CARRYING OUT THE INVENTION

Figure 3:
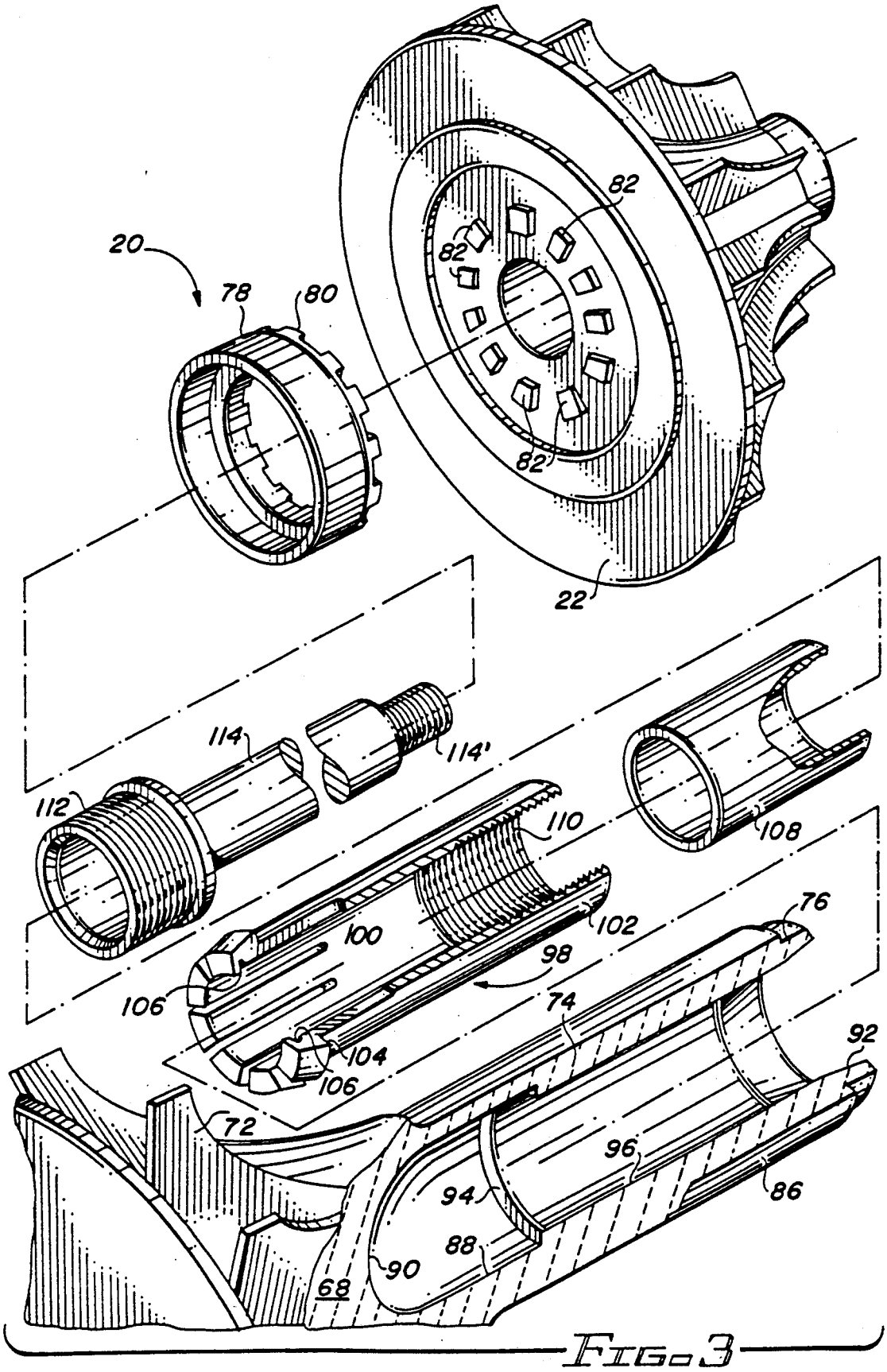
FIG. 3 provides an exploded perspective view of a turbine rotor assembly portion of the turbine engine, with parts thereof omitted or broken away for clarity of illustration.

FIG. 1 depicts a hybrid ceramic metallic turbine engine 10. The engine 10 includes a housing 12 which defines an inlet 14, an outlet 16, and a tortuous flow path 18 communicating the inlet 14 with the outlet 16 for conveying a flow of fluid therebetween. A hybrid ceramic/metallic rotor member generally referenced with the numeral 20 is journaled in the housing 12 and cooperates therewith to bound the flow path 18. It will be seen that the rotor member 20 includes a compressor rotor portion 22, rotation of which inducts ambient air via inlet 14, as indicated by arrow 24, and delivers this air pressurized to a flow path section 18' as indicated by arrow 26.

The flow path section 18' leads axially through a segment of somewhat less than 180° of a rotary annular regenerator member 28 which is received in the housing 12. Downstream of the regenerator 28, the flow path 18 leads through an axially extending combustion structure generally referenced with the numeral 30. The combustor structure 30 is fabricated of ceramic material and includes a ceramic outer liner 32 which is supported at one end by a generally cone-shaped outer transition member 34. A ceramic inner combustion liner 36 is coaxially disposed within the outer liner 32, and is supported at one end on a ceramic transition duct member 38. The flow path 18 leads axially toward the one end of the combustion liner 36, as indicated by arrow 18''. Within the transition duct member 38, a ceramic turbine back shroud member 40 and a ceramic turbine stator member 42 cooperatively define the flow path 18, and lead the latter radially inwardly to a ceramic turbine rotor portion 44 of the rotor member 20.

Downstream of the turbine rotor portion 44, the flow path 18 extends axially and radially outwardly between a pair of spaced apart cooperative ceramic exhaust duct members, respectively referenced with the numerals 46,48. A plurality of hybrid ceramic/metallic fastener members 50 (one of which is visible in FIG. 1) cooperatively engage the one exhaust duct member 46 and the housing 12. A ceramic spacer member 52 received over the fastener members 50 spaces apart the duct members 46,48.

Subsequent to the exhaust duct members 46,48, the flow path 18 leads to an exhaust chamber generally referenced with the numeral 54. A segment of somewhat less than 180° of the ceramic regenerator member 28 is exposed to the exhaust chamber 54. Consequently, the flow path 18 leads once again through the regenerator member 28, and to ambient via the outlet 16.

In order to complete this description of the engine 10, it must be noted that in the combustor 30 fuel is added to the pressurized air flowing from compressor rotor 22 to support combustion. This combustion results in a flow of high temperature pressurized combustion products flowing downstream in the combustor 30, and in flow path 18 subsequent to the combustor. Also, the rotor member 20 is journaled in housing 12 by a journal bearing 56 disposed between the rotor portions 22 and 44, and a rolling element bearing (not visible in the figures) disposed adjacent a metallic power output shaft portion 60 (only a portion of which is visible in FIG. 1) of the rotor member 20.

Viewing now FIGS. 2 and 3 in conjunction, it will be seen that the hybrid ceramic/metallic rotor member 20 includes not only the metallic compressor rotor portion 22, the ceramic turbine rotor portion 44, and metallic power output shaft portion 60(not visible in FIGS. 2 and 3), but also a torque transmitting and concentricity retaining coupling structure generally referenced with the numeral 62, and an axial retention coupling structure generally referenced with the numeral 64. The coupling structures 62 and 64 are cooperative to unite the portions 22, 44 and 60 to define the rotor member 20.

Both the metallic compressor rotor portion 22 and the ceramic turbine rotor portion 44 include an individual hub part, respectively referenced with the numerals 66 and 68. Similarly, each of the rotor portions 22 and 44 include a plurality of circumferentially arrayed integral blade parts, respectively referenced with the numerals 70 and 72, which extend both axially and radially outwardly on the hub parts 66,68. The turbine rotor portion 44 includes an integral elongate axially extending stepped cylindrical boss part 74 extending from the hub 44 toward the compressor rotor portion 22. Carried upon a reduced diameter end parc 76 of the cylindrical part 74 is a metallic collar member 78. The collar member 78 on one side defines a plurality of radially and axially extending circumferentially arrayed curvic coupling teeth 80 which mes.h with a similar array of curvic teeth 82 defined by the hub part 66 of rotor portion 22. Because of the intermeshing of the teeth 80,82, the hub part 66 and collar member 78 are coupled in torque transmitting relation, and are also retained concentrically to one another while allowing for differential thermal and centrifugal expansions of these components.

In order to unite with the cylindrical part 74 of the rotor portion 44, the collar member 78 includes an axially extending band portion 84 circumscribing the reduced diameter end part 76 of rotor portion 44. The band portion 84 and reduced diameter part 76 define an interference fit therebetween so that collar 78 is permanently united with rotor portion 44. Preferably, the interference fit between band portion 84 and part 76 of the rotor member 44 is established by separately relatively heating the collar 78 while relatively cooling the rotor part 76. While this temperature difference between the collar 78 and part 76 of rotor 44 exists, the two are united, and thereafter allowed to come to temperature equilibrium. This type of interference fit is conventionally referred to as a "shrink fit".

It will be noted that a radially outwardly disposed elongate cylindrical surface 86 of the cylindrical portion 74 is radially outwardly circumscribed and confronted by the bearing 56. That is, the surface 86 defines for the rotor member 20 a journal surface by which the rotor member is rotatably supported in housing 12. Axial location of the rotor member 20 in housing 12 is controlled by a rolling element bearing (not shown in the figures) engaging the power output shaft portion 60 (viewing FIG. 1) of the rotor member 20. The bearing 58 also serves as a thrust rolling element bearing to transmit axial forces from rotor member 20 to the housing 12.

Also defined by the ceramic rotor portion 44 is an axially extending stepped blind bore 88. The bore 88 includes a hemispherical end wall 90 which is disposed generally within the hub 68 of the rotor portion. The bore 88 terminates in an opening 92 within end part 76, and defines a step 94 disposed toward the end wall 90 and spaced intermediate the latter end wall and opening 92. Step 94 is defined by the cooperation of a smaller diameter bore portion 96 with the remainder of bore 88.

Received into the bore 88 is an elongate metallic annular collet member 98. The collet member 98 includes a circumferentially arrayed plurality of elongate radially resilient finger portions 100 integral with and extending axially from a ring portion 102 of the collet member. Each of the finger portions 100 defines a respective radially outwardly extending shoulder 104 and a radially inwardly extending step 106. The finger portions 100 may be considered to collectively define a single radially outwardly extending shoulder 104 and a single radially inwardly extending step 106. The shoulders 104 of the fingers 100 each engage the step 94 of bore 88, while a metallic locking sleeve member 108 is received within the fingers 100 and engages the steps 106 thereof. The ring portion 102 of collet 98 includes a thread-defining portion 110 into which a termination portion 112 of an elongate metallic tie bolt member 114 is threadably received. The termination portion 112 traps the locking sleeve member 108 within the fingers 100, and thereby positively prevents their disengagement from step 94. At its end opposite the termination portion 112, the tie bolt member 114 carries a nut (not visible in the figures) on a threaded part 114' thereof and which bears upon the power output shaft portion 60 of the rotor member 20. Consequently, the collet member 98 and tie bolt 114 are stressed in tension, while the remainder of the rotor member 20 rightwardly of the collet member 98 is loaded in compression.

In view of the above, it is easily seen that the coupling structure 62 is preserved in torque transmitting relative position by the axial retention effect provided by the coupling structure 64. It should be noted that compressor rotor portion 22 and power output shaft portion 60 also define a curvic coupling therebetween so that torque from turbine 44 may be delivered externally of the engine 10 via the shaft portion 60.

It will be understood that during manufacture of the rotor member 20, the metallic collet member 98 is inserted from outside through the opening 92 and into bore portion 96 such that the finger portions 100 resiliently deflect radially inwardly. This deflection of the finger portions 100 allows the shoulders 104 to pass through bore portion 96 and into the remainder of the bore 88 beyond step 94. Thereafter, the metallic locking sleeve 108 is inserted into the collet member 98 so that the fingers 100 cannot deflect radially inwardly to pass the shoulders 104 outwardly of the step 94. With the sleeve member 108 received into the collet member 98, the end termination portion 112 of the tie bolt 114 is threadably engaged at 110 with the collet member 98. Thus, the sleeve member 108 is trapped within the collet member 98, and the latter is trapped within the bore 88. Of course, reversal of the assembly procedure allows the rotor member 20 to be disassembled into its component parts, should such be desired.

Also, it will be recalled that during operation of the turbine engine 10, the turbine rotor portion 44 is exposed to a flow of high temperature pressurized combustion products. This flow of combustion products has a temperature in the range of 2000° F. (1090° C.) to 2500° F. (1370° C.), or more, and may be expected to be of an oxidizing nature. Consequently, the temperature experienced at the end of the journal bearing surface 86 closest axially to the turbine hub 68 will be about 1200° F. (650° C.). Under these conditions, a metallic journal surface at 86 would not favorably endure. That is, the surface 86, were it made of a metallic material, would oxidize and degrade, resulting in a detrimental operating condition for the journal bearing 56, and shortened operating life. On the other hand, the ceramic surface 86 of the turbine rotor portion 44 well endures 1200° F. (650° C.) operation in an oxidizing atmosphere to provide a smooth journal surface and long life for bearing 56.

Further to the above, in view of the 1200° F. (650° C.) operating temperature at surface 86 adjacent the left end of bearing 56, it is easily appreciated that the coupling structure 64 must endure temperatures in the range extending to about 1200° F. (650° C.). This high temperature at the coupling structure 64 rules out the use of all conventional shrink fit, brazed, and adhesively joined ceramic/metal joints. None of these conventional ceramic/metal Joint structures are capable of enduring the operating environment which the coupling structure 64 endures very well.

Finally, it will be noted that the turbine rotor portion 44 defines a rather limited conductive heat transfer path extending from the hub part 68 rightwardly toward the coupling structures 62 and 64. That is, the turbine rotor portion 44 defines only an annular conductive heat transfer path radially between the surface 86 and the bore 88 within which heat is conducted axially rightwardly, viewing FIG. 2. Because of the relatively limited size of this heat transfer path and the distance of coupling structure 62 from the hub part 68, the operating temperatures experienced at the collar 78 are low enough to allow the shrink fit ceramic/metallic joint thereat to serve satisfactorily.

While the present invention has been depicted and described by reference to a single preferred embodiment of the invention, such reference does not imply any limitation upon the invention, and no such limitation is to be inferred. The invention is intended to be limited only by the spirit and scope of the appended claims which provide additional definition of the invention,

What is claimed is:

1. A hybrid ceramic/metallic structure comprising: a first ceramic portion defining a respective first axially extending bore opening outwardly thereon, said first portion further defining on said first bore an annular step disposed away from said bore opening, a second portion axially adjacent said first ceramic portion, a metallic annular collet member received into said first bore and including a circumferentially arrayed plurality of axially elongate radially resilient finger portions, said plurality of finger portions proximate the distal end thereof defining a radially, outwardly extending shoulder engaging said step, tensile means engaging said collet member and extending axially toward said second portion for applying an axially directed tensile force to the collet member which force is reacted through the second portion to secure the latter and said first portion axially together.

2. The invention of claim 1 wherein said second portion defines a respective axially extending second bore coaxial with said first bore, said tensile means including an elongate tie bolt member adjacent one end thereof engaging said collet member and extending from said first portion into said second bore.

3. The invention of claim 2 wherein said second bore extends axially through said second portion, said tie bolt member extending through said second portion, and said tensile means further including a nut member engaging said tie bolt member adjacent a second end thereof opposite said one end.

4. The invention of claim 1 wherein said first portion and said second portion define cooperating means for on the one hand transmitting torque between said portions and on the other hand maintaining coaxial alignment of said portions.

5. The invention of claim 4 wherein said cooperating means includes said first ceramic portion carrying a metallic collar member permanently secured thereto, said metallic collar member defining a first circumferentially arrayed plurality of axially and radially extending teeth, said second portion defining a respective second circumferentially arrayed plurality of axially and radially extending teeth meshing with said first plurality of teeth.

6. The invention of claim 5 wherein said first ceramic portion defines an axially extending circularly cylindrical boss part, said collar member including a band portion cooperating with the remainder thereof to define a recess, said boss part being received into said recess and said band portion defining an interference fit therewith.

7. The invention of claim 1 further including a locking member received into said collet member and engageable radially by said finger portions to prevent disengagement of the latter from said step.

8. The invention of claim 7 wherein said locking member includes an elongate sleeve member received axially within said finger portions, said finger portions also defining a radially inwardly extending second step engageable by said sleeve member to prevent axial movement of the latter in one direction.

9. The invention of claim 8 wherein said tensile means defines an abutment surface confronting and spaced axially from said second step and engageable by said sleeve member to trap the latter therebetween.

* * * * *